US007780024B1

(12) United States Patent
Marsella et al.

(10) Patent No.: US 7,780,024 B1
(45) Date of Patent: Aug. 24, 2010

(54) SELF PEEL FLICK-IT SEAL FOR AN OPENING IN A CONTAINER NECK

(75) Inventors: Louis J. Marsella, Reno, NV (US); Randall G. Bush, Evansville, IN (US); William J. Shankland, Evansville, IN (US)

(73) Assignees: Rexam Closures and Containers Inc., Evansville, IN (US); Momar Industries LLC, Chicago, IL (US)

( * ) Notice: Subject to any disclaimer, the term of this patent is extended or adjusted under 35 U.S.C. 154(b) by 37 days.

(21) Appl. No.: 11/339,000

(22) Filed: Jan. 25, 2006

Related U.S. Application Data

(63) Continuation-in-part of application No. 11/181,576, filed on Jul. 14, 2005.

(51) Int. Cl.
*B65D 41/00* (2006.01)

(52) U.S. Cl. ..... 215/350; 215/351; 215/349; 215/276; 215/341

(58) Field of Classification Search ..... 215/349–352, 215/276, 341
See application file for complete search history.

(56) References Cited

U.S. PATENT DOCUMENTS

| | | | | |
|---|---|---|---|---|
| 946,138 | A | 1/1910 | Kirkegaard | |
| 1,346,112 | A | 7/1920 | Bruns | |
| 1,556,020 | A | 10/1925 | Noll | |
| 1,910,913 | A | 5/1933 | Conner | |
| 1,916,977 | A | 7/1933 | Gutmann | |
| 1,937,492 | A | 11/1933 | Merolle | |
| 1,961,033 | A | 5/1934 | Bicks | |
| 1,995,350 | A | 3/1935 | Hoag | |
| 2,039,757 | A | 5/1936 | Von Till | |
| 2,085,934 | A | 7/1937 | Von Till | |
| 2,188,946 | A | 2/1940 | Gutmann | |
| 2,242,256 | A | 5/1941 | McManus | |
| 2,312,513 | A | 3/1943 | Wilson | |
| 2,620,939 | A | 12/1952 | Weisgerber | |
| 2,643,021 | A | 6/1953 | Freedman | |
| 2,670,869 | A * | 3/1954 | Martin | 215/329 |
| 2,681,742 | A | 6/1954 | Miller | |
| 2,686,606 | A | 8/1954 | Froitzheim | |
| 2,686,607 | A | 8/1954 | Zander | |
| 2,748,969 | A * | 6/1956 | Leary | 215/329 |
| 2,904,837 | A | 9/1959 | Crabbe | |
| 2,929,525 | A | 3/1960 | Glover | |
| 3,143,364 | A | 8/1964 | Klein | |
| 3,169,656 | A * | 2/1965 | Wieckmann | 215/329 |
| 3,186,209 | A | 6/1965 | Friedman | |

(Continued)

FOREIGN PATENT DOCUMENTS

| | | |
|---|---|---|
| CA | 2572379 | 12/2006 |

(Continued)

*Primary Examiner*—Anthony Stashick
*Assistant Examiner*—Christopher B McKinley
(74) *Attorney, Agent, or Firm*—Chad Bruggeman; John Salazar; Middleton Reutlinger

(57) ABSTRACT

A self peelable seal having one or more layers for sealing containers by heat induction, conduction, or other means and having a stiffening structure. A portion of the seal is axially retained within a closure thereby allowing the peelable seal to be loosened from the container neck by placing a lifting force on the seal with the closure upon removal of the closure from the container.

12 Claims, 8 Drawing Sheets

U.S. PATENT DOCUMENTS 3,189,209 A * 6/1965 Owens ..... 215/329
3,224,617 A 12/1965 Hohl
3,245,857 A 4/1966 Rutledge
3,255,907 A 6/1966 Eddy
3,266,658 A 8/1966 Meissner
3,331,523 A 7/1967 Exton
3,360,149 A 12/1967 Roth
3,501,042 A 3/1970 Risch
3,527,372 A 9/1970 Manning
3,530,917 A 9/1970 Donovan
3,547,294 A 12/1970 Williams
3,612,325 A 10/1971 Williams
3,632,004 A 1/1972 Grimes
3,788,510 A 1/1974 Collins
3,815,314 A 6/1974 Pollock et al.
3,823,182 A 7/1974 Nonaka et al.
3,845,525 A 11/1974 Gaylord
3,879,492 A 4/1975 Botinick
3,910,410 A 10/1975 Shaw
3,917,100 A * 11/1975 Dukess ..... 215/329
3,923,179 A 12/1975 Choksi
3,923,182 A 12/1975 Choksi
3,923,183 A 12/1975 Choksi
3,923,184 A 12/1975 Choksi
3,923,185 A 12/1975 Choksi
3,944,103 A 3/1976 Cros
3,973,719 A * 8/1976 Johnson et al. ..... 229/5.6
3,980,194 A 9/1976 Costa
4,007,848 A 2/1977 Snyder
4,009,793 A 3/1977 Minesinger et al.
4,013,188 A * 3/1977 Ray ..... 215/347
4,066,181 A 1/1978 Robinson et al.
4,076,152 A 2/1978 Mumford
4,091,949 A 5/1978 Fowles et al.
4,093,093 A 6/1978 Fowles et al.
4,109,815 A 8/1978 Collins, III
4,128,184 A * 12/1978 Northup ..... 215/222
4,151,924 A 5/1979 Jameson
4,181,232 A 1/1980 Bellamy et al.
4,204,604 A 5/1980 Morin et al.
4,207,990 A 6/1980 Weiler et al.
4,209,126 A 6/1980 Elias
4,266,687 A 5/1981 Cummings
4,275,817 A 6/1981 Patton
4,276,989 A 7/1981 Hicks
4,280,653 A 7/1981 Elias
4,358,919 A 11/1982 Hirota et al.
4,364,485 A 12/1982 Knapp
4,369,889 A 1/1983 Ostrowsky
4,378,894 A 4/1983 Willis et al.
4,381,840 A * 5/1983 Ostrowsky ..... 215/329
4,382,521 A 5/1983 Ostrowsky
4,392,579 A 7/1983 Uhlig et al.
4,423,821 A 1/1984 McIntosh
4,427,126 A 1/1984 Ostrowsky
4,430,288 A 2/1984 Bonis
4,434,904 A 3/1984 D'Amico et al.
4,457,440 A * 7/1984 Dukess ..... 215/347
4,473,163 A 9/1984 Geiger
4,493,427 A 1/1985 Wolkonsky
4,496,674 A 1/1985 Ehrhart et al.
4,501,371 A 2/1985 Smalley
4,526,279 A 7/1985 Weiler et al.
4,527,705 A 7/1985 Prades
4,564,117 A * 1/1986 Herbert ..... 215/329
4,576,297 A * 3/1986 Larson ..... 215/250
4,583,665 A 4/1986 Barriac
4,588,099 A 5/1986 Diez
4,625,875 A 12/1986 Carr et al.
4,637,519 A 1/1987 Dutt et al.
4,638,913 A 1/1987 Howe, Jr.
4,643,330 A 2/1987 Kennedy
4,648,520 A 3/1987 Stull
4,651,886 A * 3/1987 Stull ..... 215/329
4,662,529 A 5/1987 Moore
4,668,458 A 5/1987 Whitney
4,674,642 A * 6/1987 Towns et al. ..... 215/230
4,674,643 A 6/1987 Wilde et al.
4,682,463 A 7/1987 Foldesi
4,683,016 A 7/1987 Dutt et al.
4,704,180 A 11/1987 Marsella et al.
4,705,188 A 11/1987 Rahn
4,706,835 A 11/1987 Kreiseder
4,709,815 A 12/1987 Price et al.
4,721,215 A 1/1988 Bertaud
4,722,447 A * 2/1988 Crisci ..... 215/232
4,723,685 A 2/1988 Fillmore et al.
4,730,748 A 3/1988 Bane
4,738,370 A 4/1988 Urmston et al.
4,747,500 A * 5/1988 Gach et al. ..... 215/250
4,747,502 A 5/1988 Luenser
4,754,890 A 7/1988 Ullman et al.
4,754,892 A * 7/1988 Retief ..... 215/329
4,757,914 A 7/1988 Roth et al.
4,764,403 A 8/1988 Ajmera
4,778,698 A 10/1988 Ou-Yang
4,779,750 A 10/1988 Armstrong
4,782,968 A 11/1988 Hayes
4,793,504 A * 12/1988 Towns et al. ..... 215/250
4,801,037 A 1/1989 Hayashida et al.
4,807,745 A 2/1989 Langley et al.
4,807,770 A 2/1989 Barriac
4,809,858 A 3/1989 Ochs
4,810,541 A 3/1989 Newman et al.
4,815,617 A 3/1989 Cullum
4,818,577 A 4/1989 Ou-Yang
4,842,951 A 6/1989 Yamada et al.
4,846,359 A 7/1989 Baird et al.
4,875,594 A 10/1989 Ochs
4,879,147 A 11/1989 Newman et al.
4,881,649 A 11/1989 Hsu et al.
4,892,911 A 1/1990 Genske
4,893,718 A 1/1990 Delespaul et al.
4,894,266 A 1/1990 Bauer et al.
4,896,783 A 1/1990 Leoncavallo et al.
4,935,273 A 6/1990 Ou-Yang
4,981,229 A 1/1991 Lanham
4,981,230 A 1/1991 Marshall et al.
4,991,731 A 2/1991 Osip et al.
4,997,097 A 3/1991 Krautkramer
5,002,811 A 3/1991 Bauer et al.
5,006,384 A 4/1991 Genske
5,007,546 A 4/1991 Rose et al.
5,009,323 A 4/1991 Montgomery et al.
5,009,324 A 4/1991 Ochs
5,011,719 A 4/1991 Gehrke et al.
5,012,946 A 5/1991 McCarthy
5,023,121 A 6/1991 Pockat et al.
5,031,787 A 7/1991 Ochs
5,058,755 A 10/1991 Hayes
5,061,532 A 10/1991 Yamada
5,069,355 A 12/1991 Matuszak
5,071,686 A 12/1991 Genske et al.
5,078,290 A 1/1992 Ochs
5,092,469 A 3/1992 Takata et al.
5,093,164 A 3/1992 Bauer et al.
5,110,642 A 5/1992 Genske
5,135,125 A 8/1992 Andel et al.
5,151,317 A 9/1992 Bothe
5,160,767 A 11/1992 Genske et al.
5,175,035 A 12/1992 Pinsolle et al.
5,176,271 A 1/1993 Painchaud et al.
5,178,293 A 1/1993 Suzuki et al.
5,197,618 A 3/1993 Goth

| | | | | |
|---|---|---|---|---|
| 5,197,620 | A | 3/1993 | Gregory | |
| 5,197,621 | A | 3/1993 | Bartl et al. | |
| 5,255,813 | A | 10/1993 | Berggren et al. | |
| 5,258,191 | A | 11/1993 | Hayes | |
| 5,259,522 | A | 11/1993 | Morton | |
| 5,265,745 | A | 11/1993 | Pereyra et al. | |
| 5,302,442 | A | 4/1994 | O'Brien et al. | |
| 5,342,684 | A | 8/1994 | Carespodi | |
| 5,346,082 | A | 9/1994 | Ochs et al. | |
| 5,353,665 | A | 10/1994 | Heebner | |
| 5,381,913 | A | 1/1995 | Peeters | |
| 5,407,751 | A | 4/1995 | Genske et al. | |
| 5,415,306 | A | 5/1995 | Luch et al. | |
| 5,421,470 | A | 6/1995 | Dudzik | |
| 5,433,992 | A | 7/1995 | Galda et al. | |
| 5,447,792 | A | 9/1995 | Brandt et al. | |
| 5,469,968 | A | 11/1995 | Matthews et al. | |
| 5,492,757 | A | 2/1996 | Schuhmann et al. | |
| 5,500,265 | A | 3/1996 | Ambroise et al. | |
| 5,513,781 | A | 5/1996 | Ullrich et al. | |
| 5,523,136 | A | 6/1996 | Fischer et al. | |
| 5,533,622 | A | 7/1996 | Stockley, III et al. | |
| 5,551,608 | A | 9/1996 | Moore et al. | |
| 5,615,789 | A * | 4/1997 | Finkelstein et al. | 215/348 |
| 5,626,929 | A | 5/1997 | Stevenson | |
| 5,664,694 | A | 9/1997 | Bietzer et al. | |
| 5,685,443 | A | 11/1997 | Taber et al. | |
| 5,702,015 | A * | 12/1997 | Giles et al. | 215/232 |
| 5,720,401 | A | 2/1998 | Moore | |
| 5,723,507 | A | 3/1998 | Markovich et al. | |
| 5,738,231 | A | 4/1998 | Montgomery | |
| 5,756,178 | A | 5/1998 | Obadia | |
| 5,773,136 | A | 6/1998 | Alder et al. | |
| 5,785,195 | A | 7/1998 | Zwemer et al. | |
| 5,788,101 | A | 8/1998 | King | |
| 5,837,369 | A | 11/1998 | Grunberger et al. | |
| 5,850,951 | A | 12/1998 | Hayes | |
| 5,851,640 | A | 12/1998 | Schuhmann et al. | |
| 5,860,544 | A | 1/1999 | Brucker | |
| 5,862,928 | A | 1/1999 | Breuer et al. | |
| 5,875,909 | A | 3/1999 | Guglielmini | |
| 5,882,789 | A | 3/1999 | Jones et al. | |
| 5,884,788 | A | 3/1999 | Wilde | |
| 5,902,075 | A | 5/1999 | Krings | |
| 5,915,577 | A * | 6/1999 | Levine | 215/232 |
| 5,925,430 | A | 7/1999 | Bayer et al. | |
| 5,927,530 | A | 7/1999 | Moore | |
| 5,929,128 | A | 7/1999 | Whetten et al. | |
| 5,947,311 | A | 9/1999 | Gregory | |
| 5,973,077 | A | 10/1999 | Kan et al. | |
| 5,992,661 | A * | 11/1999 | Zumbuhl | 215/252 |
| 5,997,968 | A | 12/1999 | Dries et al. | |
| 6,006,930 | A | 12/1999 | Dreyer et al. | |
| 6,044,994 | A | 4/2000 | Miller | |
| 6,056,136 | A | 5/2000 | Taber et al. | |
| 6,056,141 | A | 5/2000 | Navarini et al. | |
| 6,068,933 | A | 5/2000 | Shepard et al. | |
| 6,082,566 | A | 7/2000 | Yousif et al. | |
| 6,082,568 | A | 7/2000 | Flanagan | |
| 6,089,390 | A | 7/2000 | Druitt et al. | |
| 6,105,800 | A | 8/2000 | Czesak | |
| 6,119,422 | A | 9/2000 | Clear et al. | |
| 6,119,883 | A | 9/2000 | Hock et al. | |
| 6,123,212 | A | 9/2000 | Russell et al. | |
| 6,152,316 | A | 11/2000 | Niese | |
| 6,152,319 | A | 11/2000 | Kamachi et al. | |
| 6,158,604 | A | 12/2000 | Larguia, Sr. et al. | |
| 6,165,576 | A | 12/2000 | Freedman et al. | |
| 6,179,139 | B1 | 1/2001 | Heilman | |
| 6,202,871 | B1 | 3/2001 | Kelly | |
| 6,206,871 | B1 | 3/2001 | Zanon et al. | |
| 6,220,466 | B1 | 4/2001 | Hayes et al. | |
| 6,231,975 | B1 | 5/2001 | Kong et al. | |
| 6,234,338 | B1 | 5/2001 | Searle | |
| 6,235,822 | B1 | 5/2001 | Whetten et al. | |
| 6,237,789 | B1 | 5/2001 | Zhu | |
| 6,239,210 | B1 | 5/2001 | Kim et al. | |
| 6,253,939 | B1 | 7/2001 | Wan et al. | |
| 6,253,940 | B1 | 7/2001 | Graham et al. | |
| 6,257,430 | B1 | 7/2001 | Rinnie et al. | |
| 6,265,083 | B1 | 7/2001 | Tanizaki et al. | |
| 6,276,543 | B1 | 8/2001 | German et al. | |
| 6,277,478 | B1 | 8/2001 | Kurita et al. | |
| 6,302,321 | B1 | 10/2001 | Reese et al. | |
| 6,315,140 | B1 | 11/2001 | Nadel | |
| 6,382,443 | B1 | 5/2002 | Gregory | |
| 6,382,445 | B1 | 5/2002 | McCandless | |
| 6,419,101 | B1 | 7/2002 | Hessel et al. | |
| 6,477,823 | B1 | 11/2002 | Kitterman et al. | |
| 6,488,165 | B1 | 12/2002 | Hidding | |
| 6,502,710 | B1 | 1/2003 | Bosl et al. | |
| 6,581,793 | B1 * | 6/2003 | Racine et al. | 215/350 |
| 6,659,297 | B2 | 12/2003 | Gregory et al. | |
| 6,848,590 | B2 | 2/2005 | Brozell et al. | |
| 6,854,614 | B2 * | 2/2005 | Sprick | 215/329 |
| 6,874,647 | B2 | 4/2005 | Bloom et al. | |
| 6,893,672 | B2 | 5/2005 | Ingraham | |
| 6,902,075 | B2 * | 6/2005 | O'Brien et al. | 215/232 |
| 6,913,157 | B2 | 7/2005 | Oh | |
| 6,948,630 | B2 | 9/2005 | Julian et al. | |
| 7,004,340 | B2 | 2/2006 | Belden, Jr. | |
| 7,021,478 | B1 * | 4/2006 | Hock | 215/349 |
| 7,168,581 | B2 * | 1/2007 | Robinson et al. | 215/349 |
| 7,175,039 | B2 | 2/2007 | German et al. | |
| 7,217,454 | B2 | 5/2007 | Smelko et al. | |
| 7,314,669 | B2 * | 1/2008 | Galloway | 428/516 |
| 2001/0012868 | A1 | 8/2001 | Chen et al. | |
| 2002/0027123 | A1 | 3/2002 | Druitt et al. | |
| 2002/0066713 | A1 | 6/2002 | Ma | |
| 2002/0162818 | A1 * | 11/2002 | Williams | 215/343 |
| 2003/0071007 | A1 | 4/2003 | Ma et al. | |
| 2003/0098285 | A1 | 5/2003 | Gregory et al. | |
| 2003/0116524 | A1 | 6/2003 | Robinson et al. | |
| 2003/0150833 | A1 | 8/2003 | Shenkar | |
| 2004/0055992 | A1 * | 3/2004 | Robinson et al. | 215/347 |
| 2004/0173944 | A1 | 9/2004 | Mueller et al. | |
| 2005/0003125 | A1 | 1/2005 | Barber et al. | |
| 2005/0211657 | A1 | 9/2005 | Mallet et al. | |
| 2005/0284837 | A1 | 12/2005 | Taber et al. | |
| 2007/0125785 | A1 | 6/2007 | Robinson et al. | |
| 2007/0138125 | A1 | 6/2007 | Granger | |
| 2007/0187352 | A1 | 8/2007 | Kras et al. | |

FOREIGN PATENT DOCUMENTS

| | | |
|---|---|---|
| DE | 3237634 | 4/1984 |
| DE | 4206244 A1 * | 9/1993 |
| EP | 0269920 | 6/1988 |
| EP | 275102 | 7/1988 |
| EP | 405365 | 1/1991 |
| EP | 0421821 | 4/1991 |
| EP | 589033 | 10/1993 |
| GB | 2034288 | 6/1980 |
| JP | 02205574 | 8/1990 |
| JP | 02219769 | 9/1990 |
| JP | 2000052982 | 2/2000 |
| JP | 2001261054 | 9/2001 |
| WO | 9009935 | 1/1990 |
| WO | 2006002922 | 1/2006 |
| WO | WO 2007042205 | 4/2007 |

* cited by examiner

SELF PEEL FLICK-IT SEAL FOR AN OPENING IN A CONTAINER NECK

CROSS-REFERENCE TO RELATED APPLICATIONS

This patent application is a continuation-in-part of and claims priority to and benefit from, currently pending, U.S. Nonprovisional patent application Ser. No. 11/181,576, filed on Jul. 14, 2005, which is incorporated herein by reference.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates generally to container inner seals, and, more specifically, to inner seals having a stiffening structure which promotes ease of removal by allowing the user to loosen or remove the inner seal by flicking an overhanging portion with a finger or by retaining a portion of the seal in the closure.

2. Description of the Related Art

In view of the need for airtight inner seals on containers for food, medicine, and the like, closures have been developed which incorporate an inner seal bonded with a sealant to an upper rim of a container rim (i.e., the landing area of the container neck). Traditional inner seals typically have an integral pull tab to grip to facilitate removal of the inner seal, or no pull tab at all, forcing the user to resort to sharp objects to scrape, puncture, or break the inner seal. These traditional inner seals thus have numerous shortcomings. Although inner seals having integral tab portions are designed for gripping, end users—particularly the elderly—may find it difficult forming the required thumb and forefinger connection to pinch and pull the tab of the inner seal up and away form the upper container rim. Scraping or puncturing the inner seal with sharp objects such as knives can be dangerous to the end user. Therefore, there is a need for inner seals which are easily removed by the end user, particularly those who cannot pinch and pull a tab, and that do not require sharp and dangerous objects to puncture the inner seal.

SUMMARY OF THE INVENTION

In view of known deficiencies associated with earlier inner seals, there is provided an inner seal or liner having one or more layers. The inner seal has a central portion or body and optionally an overhanging portion extending beyond the margin or fringe of the central portion of the inner seal. In a single-layer inner seal, the inner seal includes a stiffening structure, such as a co-extruded film actually consisting of a plurality of materials. In a multi-layer inner seal, the inner seal includes the stiffening structure (or layer), and can further include an intermediate layer and a structure adapted for sealing or bonding the inner seal against an upper rim of a container (or landing area of a container neck). These layers may be stacked in the order recited, and are secured together in a composite sheet with adhesives known in the art.

In an embodiment of the seal having an overhanging portion, the overhanging portion may circumscribe the periphery of the central portion or body of the inner seal, and includes the stiffening structure, which facilitates removal of the inner seal by flicking the overhanging portion with a finger or retaining it within the closure. In an alternative embodiment, the seal has a post with a head extending through a hole in the top wall of the closure. The head has a larger diameter than the hole in the closure top wall, thus retaining the seal within the closure. In this embodiment the seal need not have an overhanging portion to be retained within the closure. The invention thus provides an inner seal easily removed not by pinching and pulling a tab, which some elderly people in particular might find difficult to perform, or by gouging the seal with a sharp object, which is dangerous, but by flicking an overhanging portion or by retaining the inner seal within the closure so that the inner seal is loosened or removed from the landing area of the container neck. The inner seal may be of any size or shape of inner seals known in the art, such as disc-shaped.

For a better understanding of the present invention, together with other and further objects thereof, reference is made to the following description, taken in conjunction with the accompanying drawings, and its scope will be pointed out in the appending claims.

BRIEF DESCRIPTION OF THE DRAWINGS

The aspects and advantages of the present invention will be better understood when the detailed description of the embodiments taken in conjunction with the accompanying drawings, in which.

DETAILED DESCRIPTION

While this invention is susceptible of embodiments in many different forms, there are shown in the Figures and will herein be described in detail, embodiments of the invention with the understanding that the present disclosure is to be considered as an exemplification of the principles of the invention, and is not intended to limit the broad aspects of the invention to the embodiments illustrated.

Figure 1:
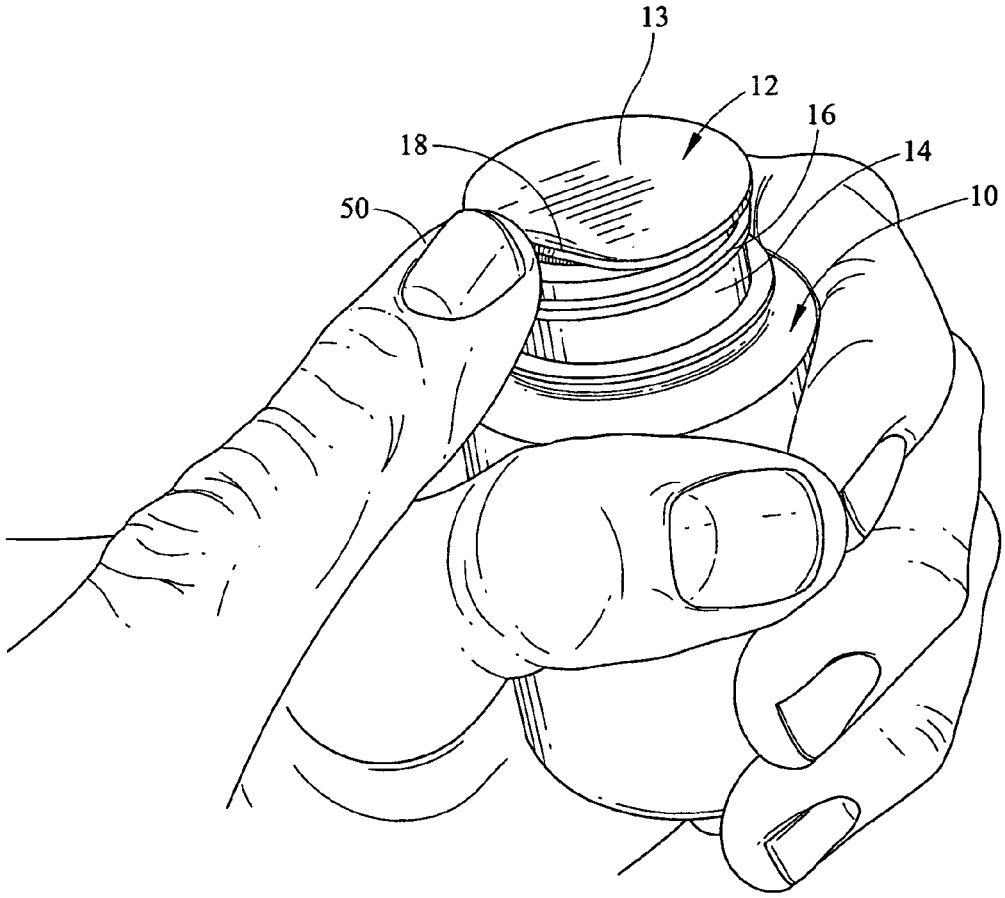
FIG. 1 is a perspective view of a peelable seal of the present invention on a container in a use condition.

As shown in FIG. 1, a peelable seal 12 having a central body portion 13 with an overhang portion 18 is attached to a neck 14 of a container 10. The seal 12 is easily loosened with the "flick" of the meat of a finger 50, so that it may be readily peeled off.

Figure 2:
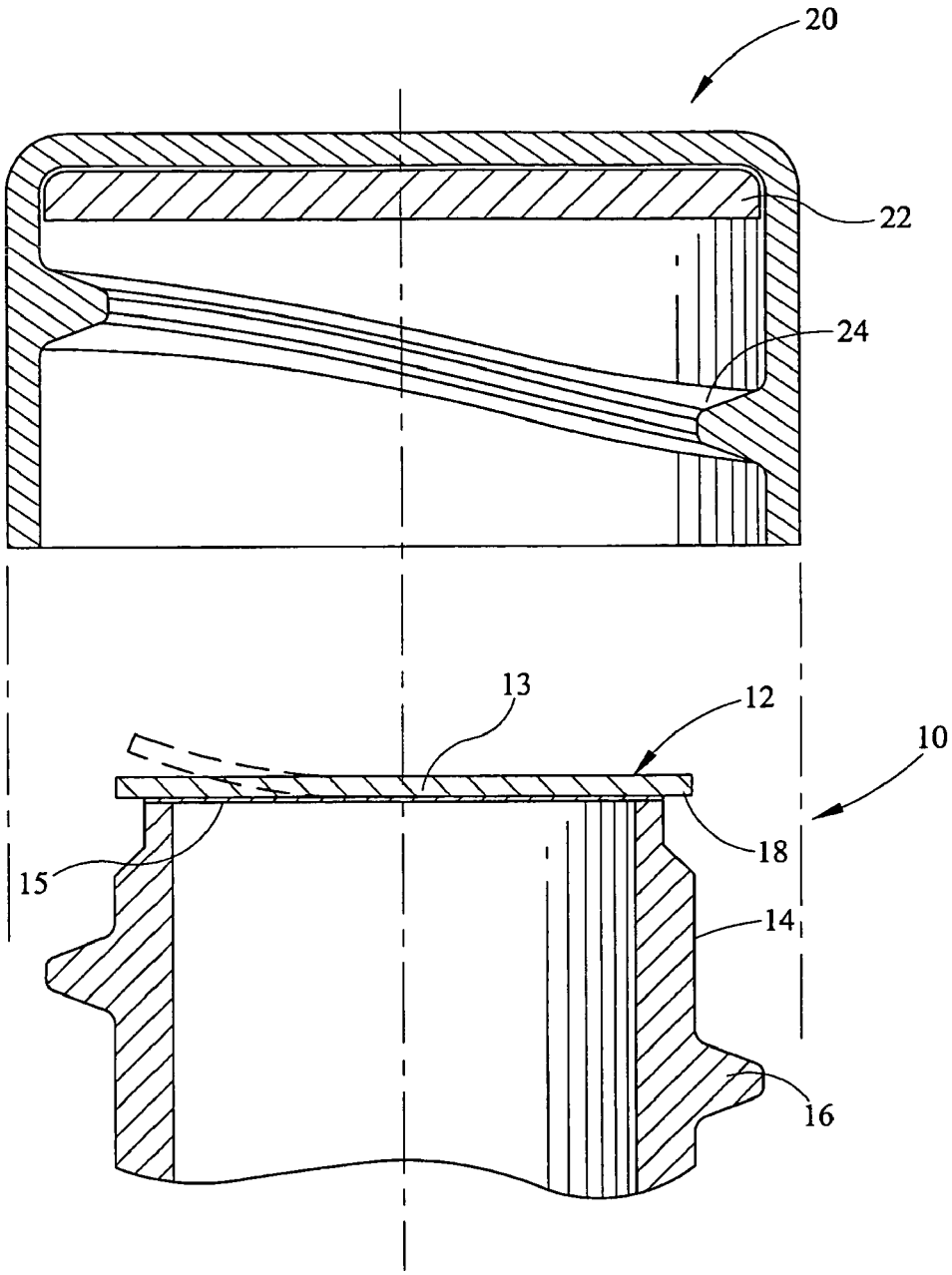
FIG. 2 is an exploded view, in section, of a peelable seal with a container and a cap, according to an embodiment of the present invention.

An embodiment of the peelable seal of the present invention is generally disc-shaped as shown in FIGS. 1, 2 and indicated by the numeral 12. The seal 12 can be associated with a wide variety of closure-container combinations, and the closure-container combination depicted in the Figures is shown as an example only. As shown in FIG. 2, the peelable seal 12 is sealingly secured over the opening to the neck 14 of container 10. Neck 14 is provided with outer container threads 16 which are engageable with closure engaging threads 24 of closure 20. Closure 20 is further provided with a backing 22 which is a resilient structure separate or integral with the closure 20.

Figure 3:
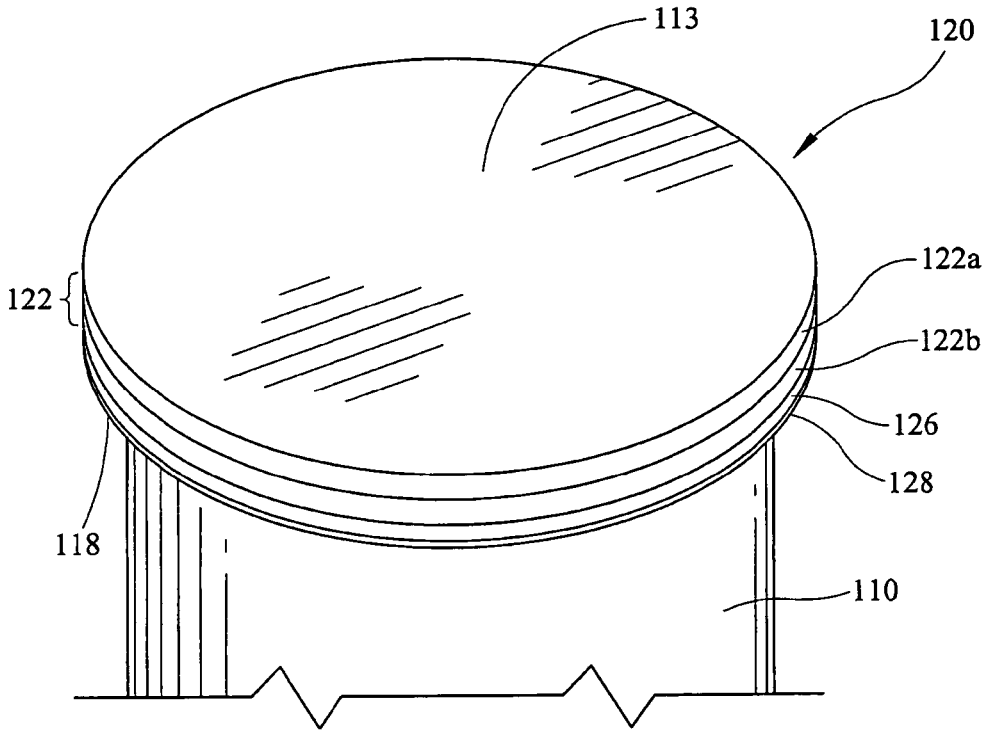
FIG. 3 is a perspective view of a peelable seal of the present invention.

As shown in FIG. 2, the seal 12 may be formed in a single layer with a central portion or body 13, and an overhanging portion 18 extending beyond the margin or fringe of the central portion 13 of the seal 12. The seal 12 may also include a plurality of layers, as is best shown in FIG. 3, including a sealant 128. As shown in FIG. 2, a sealant 15 (or bonding layer), is used for attachment to the rim of neck 14. The sealant may be formed of polypropylene, polyethylene ethylene vinyl acetate copolymer (EVA), polyester or a similar heat sealable material having relatively low density and tensile strength, and applied to the seal 12 on a side adjacent to the rim of the neck 14. Preferably, the sealant 15 would be the same material as the container 10.

In a single-layer seal 12 configuration, the seal 12 may include a stiffening structure, such as a co-extruded film actually consisting of a plurality of materials. The single-layer seal 12 configuration would be a construction in which a hot iron (not shown) is used to bond the seal to the upper rim of a container 10 (or landing area of a container neck 14). The materials must be stiff such that the seal 12 could be "flicked" as shown in FIG. 1 to loosen it, and then peeled off without the need to form the forefinger and thumb gripping configuration. In the single-layer seal configuration, the stiffening structure may be as thin as about 0.010 inches thick, and the sealant may be about 0.0001 inches thick.

A multi-layer seal 120 as shown in FIG. 3 may include a layer 122 of a stiffening structure; an intermediate layer 126; and a sealant structure 128. The intermediate layer 126 may be a foil layer, and may be any metallic foil, preferably a stiff metallic material such as for example, aluminum. The bottom of sealant structure 128 can be adapted for sealing or bonding the seal against the upper rim of a container 110 (or landing area of a container neck). These layers may be stacked in the order recited, and are secured together in a composite sheet with adhesives known in the art. In defining the stacked layer seal 120, seal 120 includes a central body portion 113 which covers the opening of a container with an outer peripheral edge or overhanging portion 118. In this scenario, the layer 122 would be from about 0.010 to 0.25 inches of combined backing materials for stiffening, the intermediate layer would be from about 0.001 inches thick to about 0.010 inches thick and the sealant would be from about 0.0001 to 0.0002 inches thick, for an overall thickness of from about 0.01 inches to about 0.025 inches.

The multi-layer peelable seal 120 configuration is comprised of a layer 122 of about 0.0120 inches thick, an intermediate layer 126 of about 0.0015 inches thick, and a sealant 128 of about 0.0010 inches thick, for an overall thickness of about 0.0145 inches. In this configuration, the layer 122 includes about 0.0020 inches of polyester (PET) and about 0.0100 inches of polypropylene (PP).

In yet another multi-layer seal configuration, seal 120 is comprised of a layer 122 of about 0.0410 inches thick, an intermediate layer 126 of about 0.0015 inches thick, and a sealant 128 of about 0.0010 inches thick, for an overall thickness of about 0.0435 inches. In this configuration, the layer 122 includes about 0.0400 inches of rubber modified polypropylene thermoplastic elastomer and about 0.0010 inches of PP. The backing material which provides stiffening structure to the top layer 122 is generally selected from any solid material providing an adequate stiffening structure such as, for example, polyethylene terephalate (PET), polypropylene (PP), Nylon, polyethylene (PE), polyvinylchloride (PVC), styrene, ethylene-vinyl-acetate (EVA), ethylene-vinyl-alcohol (EVOH), Vinyl, foams of the preceding materials, paper, a stiff metallic material such as aluminum or steel, or combinations thereof. The preferred backing material is PET, PP, PVC, a stiff metallic material or paper.

The peelable seal 12 or 120 may be applied to a container in a conventional manner. The seal 12 or 120 typically is placed inside a closure 20 by a closure manufacturer, and the closures 20 typically are supplied to a packager of the container with the seals 12 or 120 retained within the closure 20. The seal 12 or 120 is sealed to a container 10 by methods that will be recognized by those skilled in the art. The closure 20 is attached to the neck 14 of the container 10. The central portion 13, 113 or body of the seal 12, 120 shown in the figures is of substantially the same size and configuration as the opening or mouth of the container 10. In the embodiments shown, the seals 12, 120 include the overhanging portion 18, 118 circumscribing the peripheral edge of the body 13, 113 of the seal 12, 120. The depth of the overhanging portion 18, 118 extends from the peripheral edge of the body portion 13, 113 beyond the rim of the container 10 usually from about 0.0050 inches to about 0.2500 inches. The preferred depth of the overhanging portion 18, 118 is about 0.0620 inches. The overhanging portion 18, 118 facilitates removal of the seals 12, 120 by one opening the container 10. Instead of pinching and pulling a tab with the thumb and forefinger, or having to remove the seal with a knife or other sharp object, as in other conventional seals, the user flicks the overhanging portion 18, 118 with the meat of the finger 50 to loosen it, and the stiffening structure provides the rigidity or resistance so that when the meat of the finger 50 meets the overhanging portion 18, 118, the seals 12, 120 pop up from the land area of the neck. The seals 12,120, in other words, are not flexible like traditional inner seals.

Figure 4:
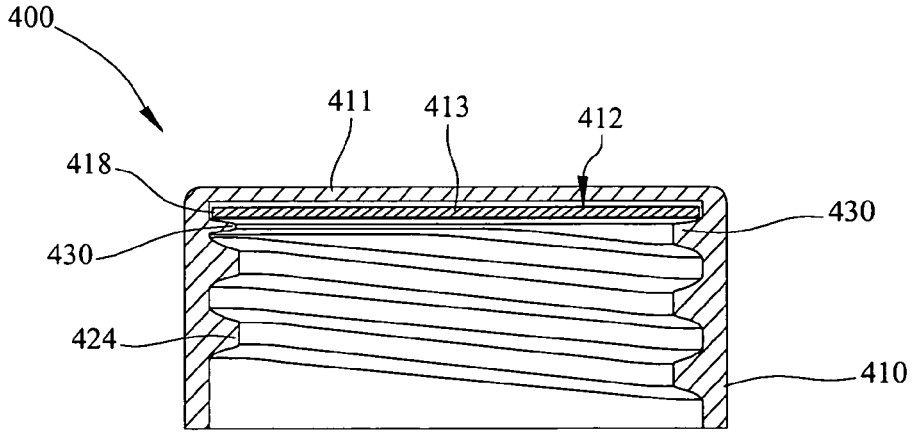
FIG. 4 is a cross-sectional view of a peelable seal of the present invention in a cap having a seal retainer cooperating with an overhanging portion.

FIG. 4 shows peelable seal 412 of the present invention in cap 400 having seal retainer 430. Peelable seal 412 may be applied to a container in a conventional manner. Seal 412 typically is placed inside closure 400 by a closure manufacturer and rotatingly axially retained therein by seal retainer 430. In this embodiment, seal retainer 430 is an extension of helical thread 424 having substantially a zero pitch near top wall 411. Seal 412 is sealed to a container by methods that will be recognized by those skilled in the art. The central portion 413 of seal 412 is of substantially the same size and configuration as the opening or mouth of a container neck with which it will be sealed. In this and other embodiments shown, seals 12, 120, 412, 512, 612, and 712 include an overhanging portion. In this embodiment, overhanging portion 418 circumscribes the peripheral edge of central portion 413 of the seal 412 beyond retainer 430. The overhanging portion 418 facilitates removal seal 412 from a container upon the removal of closure 400 from a container. The user removes closure 400 from the container by rotating closure 400 in a counterclockwise direction engaging helical thread 424 on the inner annular surface of side wall 410 with a helical thread on the closure. Overhanging portion 418 is retained by seal retainer 430 and seal 412 is removed there with.

Figure 5:
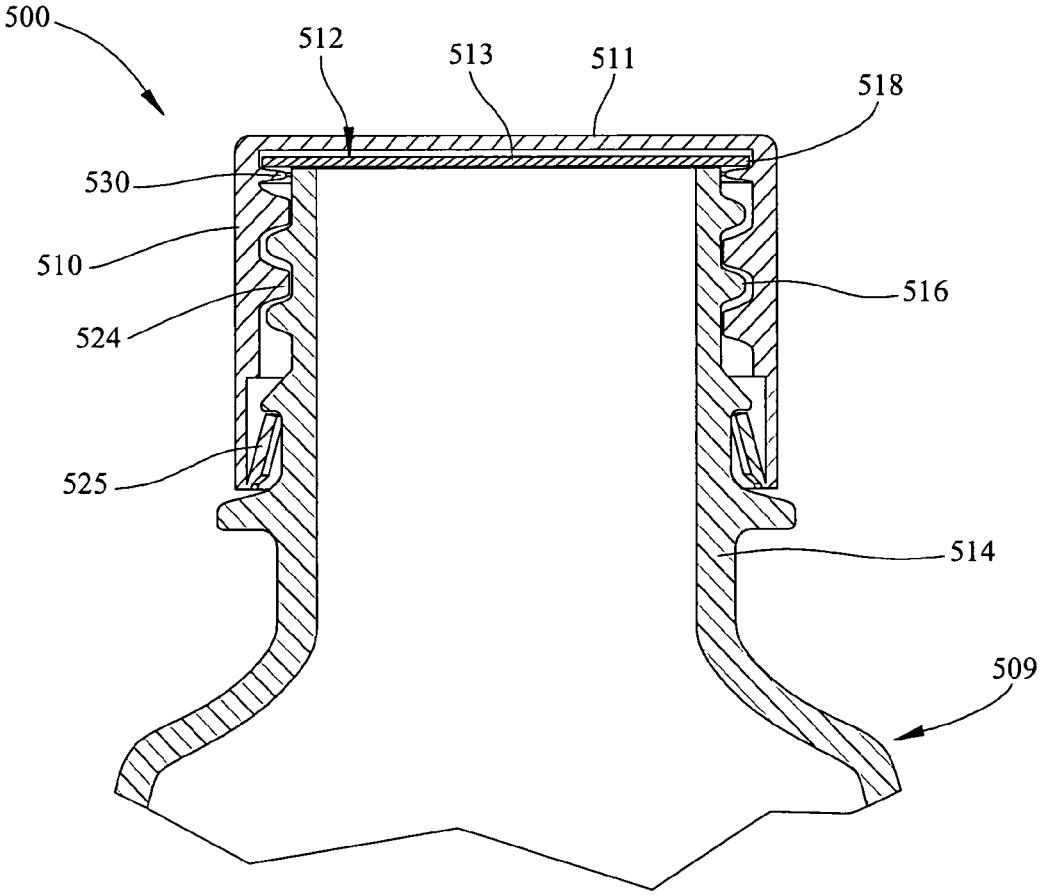
FIG. 5 is a cross-sectional view of a peelable seal of the present invention in a closure having a seal retainer wherein the closure is on a container in a use condition.

FIG. 5 shows peelable seal 512 of the present invention in closure 500 having seal retainer 530 on container 509 in a use condition. Seal 512 typically is placed inside closure 500 and retained therein with seal retainer 530. In this embodiment, seal retainer 530 is a coextensive bead circumscribing the inner annular surface of side wall 510 a sufficient distance from top wall 511. Seal 512 is shown sealed to container neck 514 of container 510. The central portion 513 of seal 512 is of substantially the same size and configuration as the opening or mouth of neck 514 of container 509 with which it is sealed. Seal 512 has overhanging portion 518 circumscribing the peripheral edge of central portion 513 of the seal 512 beyond retainer 530. The overhanging portion 518 facilitates removal seal 512 from container 509 upon the removal of closure 500 from container 509. The user rotatingly removes closure 500 from container 509 with a counter clockwise force causing container threads 516 to interact with closure threads 524. Overhanging portion 518 is retained by seal retainer 530 and seal 512 is removed there with. Also shown in this embodiment is tamper evident ring 525 which is an optional feature that may be included with any embodiment of the present invention.

Figure 6:
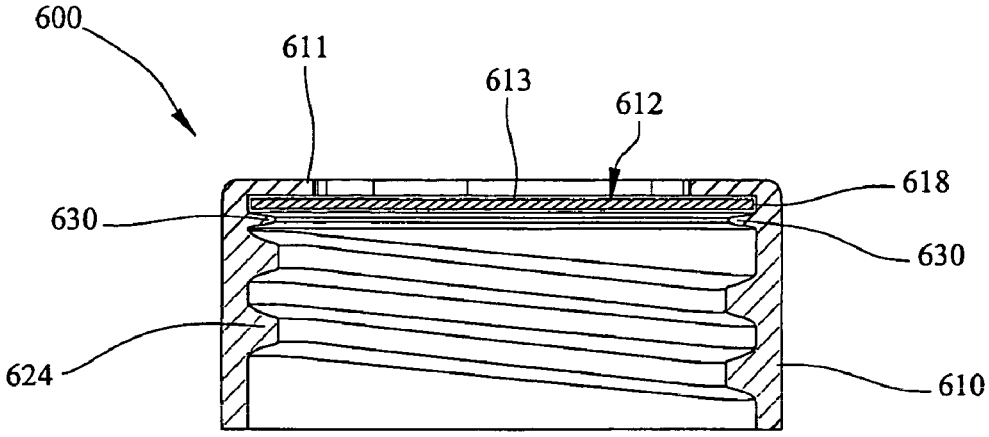
FIG. 6 is a cross-sectional view of a peelable seal of the present invention in a cap having a seal retainer that also functions as a top wall of the cap.
Figure 7:
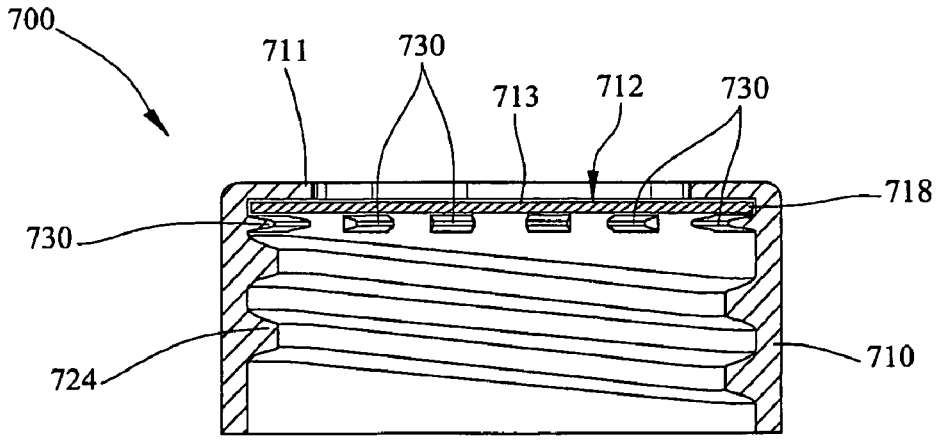
FIG. 7 is a cross-sectional view of a peelable seal of the present invention in a cap having an alternative embodiment of a seal retainer.

FIGS. 6 and 7 show peelable seals 612 and 712 of the present invention in a cap having seal retainers 630 and 730 respectively where seals 612 and 712 function as a top wall of caps 600 and 700. Peelable seals 612 and 712 may be applied to a container in a conventional manner. Seals 612 and 712 typically are placed inside closures 600 and 700 and retained therein by seal retainers 630 and 730. Seal retainer 630 is a substantially uniform retaining bead circumscribing the inner annular surface of cap side wall 610 while seal retainer 730 is an interrupted retaining bead circumscribing the inner annular surface of cap side wall 710. The central portions 613 and 713 of seals 612 and 712 function as top walls of closures 600 and 700. Seals 612 and 712 have overhanging portions 618 and 718 residing above seal retainers 630 and 730 and below top seal retainers 611 and 711. Top seal retainers 611 and 711 are shown as an inward depending side wall and have a thickness sufficient to provide a sealing force on the top periphery of seals 612 and 712. It is to be understood that top seal retainers 611 and 711 are optional since a seal is formed between seals 612 and 712 and a container neck. Seal retainers may be in the form of a retaining bead or even an intermittent retaining bead. Overhanging portions 618 and 718 circumscribe the peripheral edge of central portions 713 and 813 of seals 612 and 712 beyond retainers 630 and 730. The overhanging portions 618 and 718 facilitate removal seals 612 and 712 from a container upon the removal of closures 600 and 700 from a container.

Figure 8:
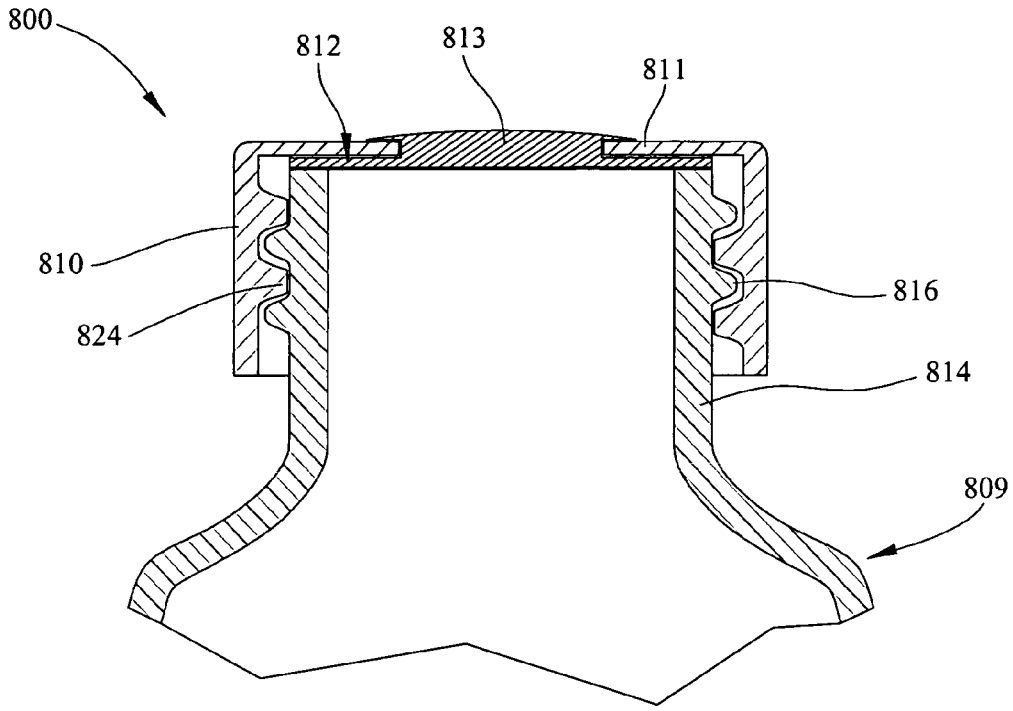
FIG. 8 is a cross-sectional view of a peelable seal of the present invention in a cap on a container having yet another embodiment of a seal retainer where the seal does not extend beyond the neck of the closure.

FIG. 8 is a cross-sectional view of a peelable seal 812 of the present invention in cap 800 on container 809. Seal 812 may be applied to a container in a conventional manner. Seal 812 typically is placed inside closure 800 by a closure manufacturer and retained therein by seal retainer 813. Seal retainer 813 is in the form of a post extending upward from seal 812 having a head with a diameter wider than the post. Closure 800 has a hole centrally oriented in a top wall 811 for receiving seal retainer 813 and having a diameter less than the diameter of the head of seal retainer 813. Seal 812 is sealed to a container by methods that will be recognized by those skilled in the art. The diameter of seal 812 is of substantially the same size and configuration as the opening or mouth of container neck 814 with which it will be sealed. Seal retainer 813 facilitates removal seal 812 from container 809 upon the removal of closure 800 from container 809 by placing an axial force on seal 812 when closure 800 is being removed from container 809. The user removes closure 800 from container 809 by rotating closure 800 in a counterclockwise direction engaging helical thread 824 on the inner annular surface of side wall 810 with helical thread 816 on container neck 814. Seal retainer 813 is retained by top wall 811 and seal 812 is removed there with.

Figure 9:
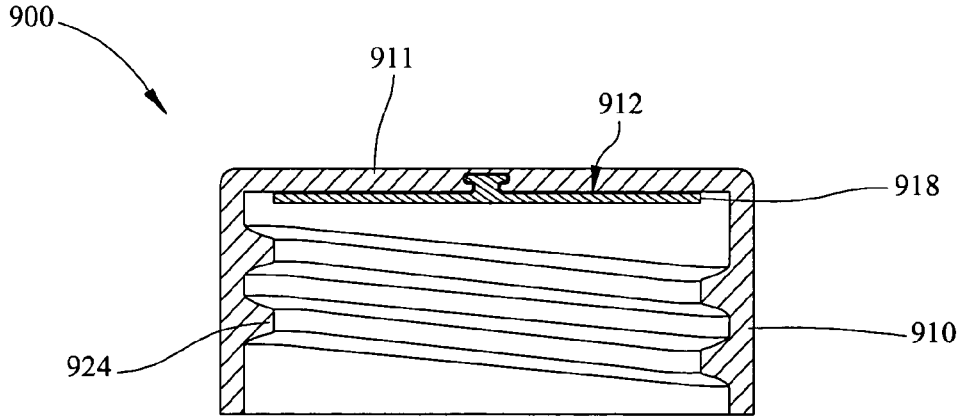
FIG. 9 is a cross-sectional view of a peelable seal of the present invention in a cap having cavity with an extension from a seal residing therein.

FIG. 9 shows peelable seal 918 of the present invention in cap 900. The seal retainer is in the form of an axial extension 913 from a central portion of seal 912 residing in cavity 914 within top wall 911 of closure 900. Also shown here is closure side wall 910 annularly depending from top wall 911 having helical thread 924 on an inner annular surface thereof.

Figure 10:
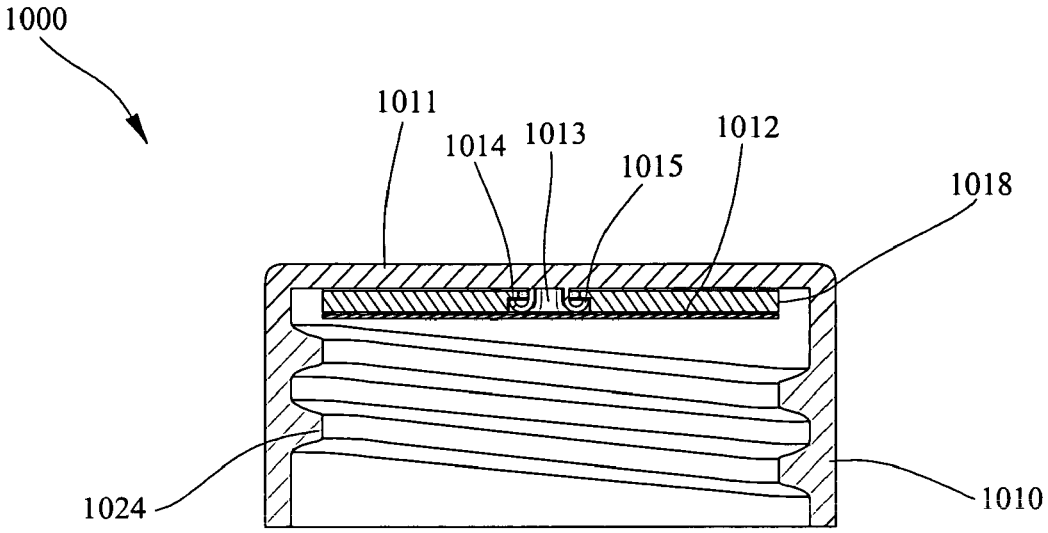
FIG. 10 is a cross-sectional view of a peelable seal of the present invention in a cap having an extension from an inner central portion engaging a central cavity within a seal.

FIG. 10 shows peelable seal 1018 of the present invention in cap 1000. The seal retainer is in the form of an axial extension 1013 from a central portion of top wall 1011 of closure 1000 having at least one outwardly extending flange 1015 extending into cavity 1014 in seal 1018 where at least outward extending flange 1015 rotatingly engages seal 1018. At least one layer 1012 of seal 1018 encloses seal 1018 on a sealing side. Also shown here is closure side wall 1010 annularly depending from top wall 1011 having helical thread 1024 on an inner annular surface thereof.

Figure 11:
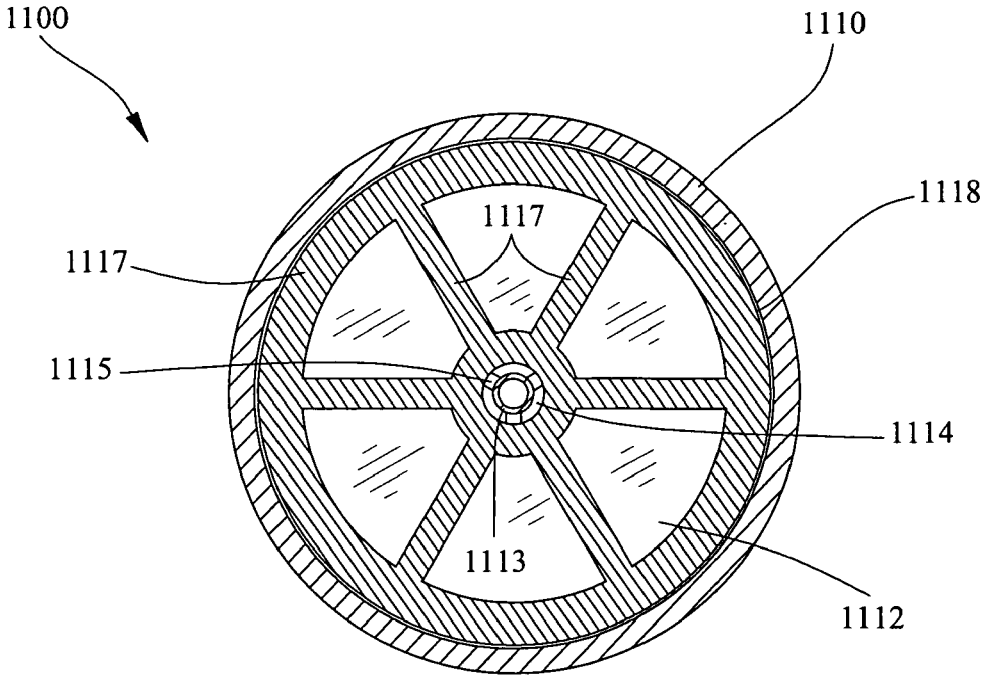
FIG. 11 is a top-sectional view of a peelable seal of the present invention having a stiffening layer with a cross-sectional area less than that of the seal.

FIG. 11 is a top-sectional view of cap 1100 having peelable seal 1118. The seal retainer is in the form of an axial extension 1113 from a central portion of a top wall of closure 1100 having at least one outwardly extending flange 1115 extending into cavity 1114 in seal 1118 where at least outward extending flange 1115 rotatingly engages seal 1118. At least one layer 1112 of seal 1118 encloses seal 1118 on a sealing side. At least one layer 1117 of seal 1118 provides a stiffening structure to seal 1118. Also shown here is closure side wall 1110 annularly depending from a top wall of closure 1100.

Figure 12:
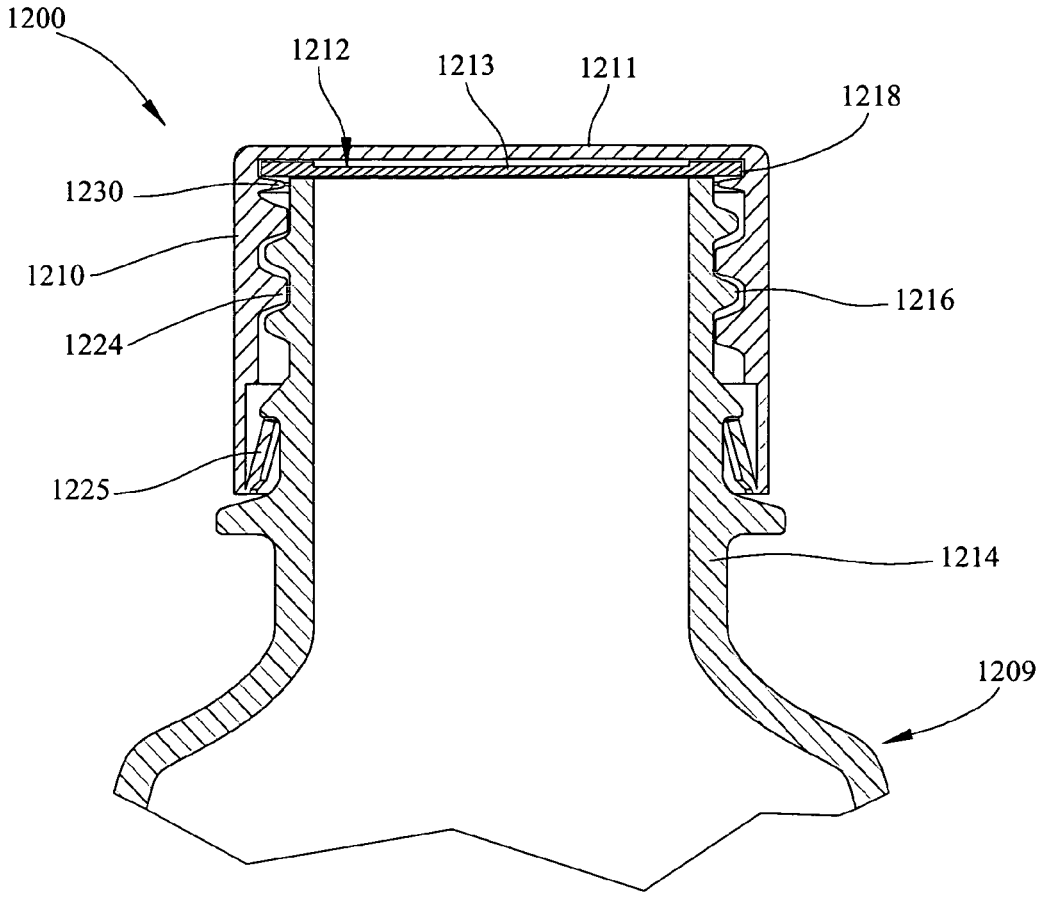
FIG. 12 is a cross-sectional view of a peelable seal of the present invention in a closure having a seal retainer wherein the closure is on a container in a use condition and has a peripheral stiffening structure.
Figure 8:
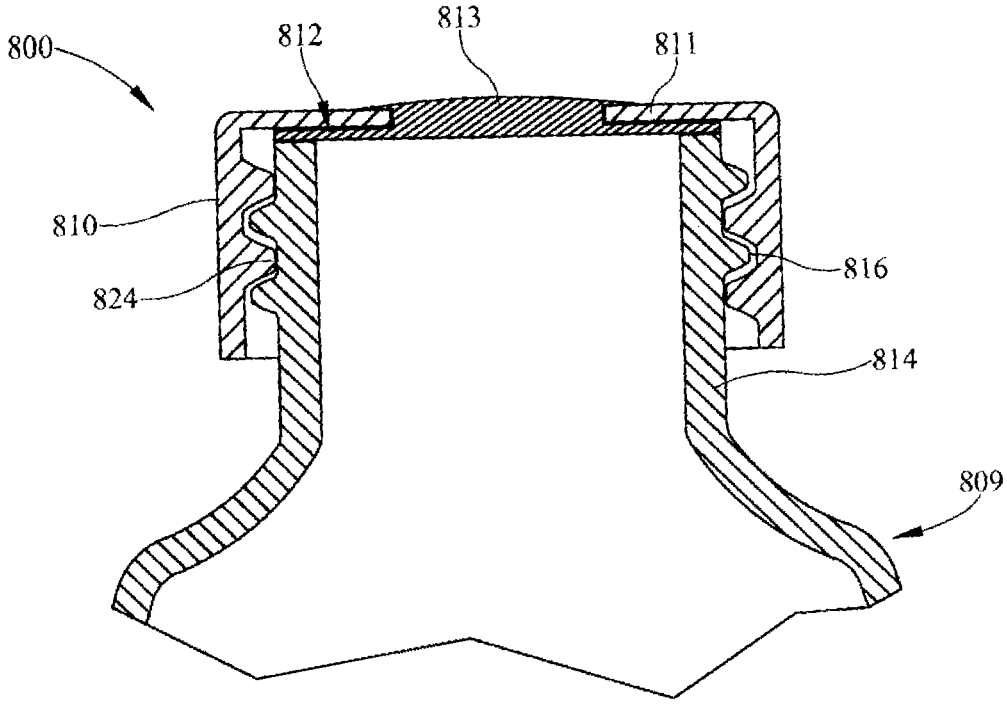
Figure 9:
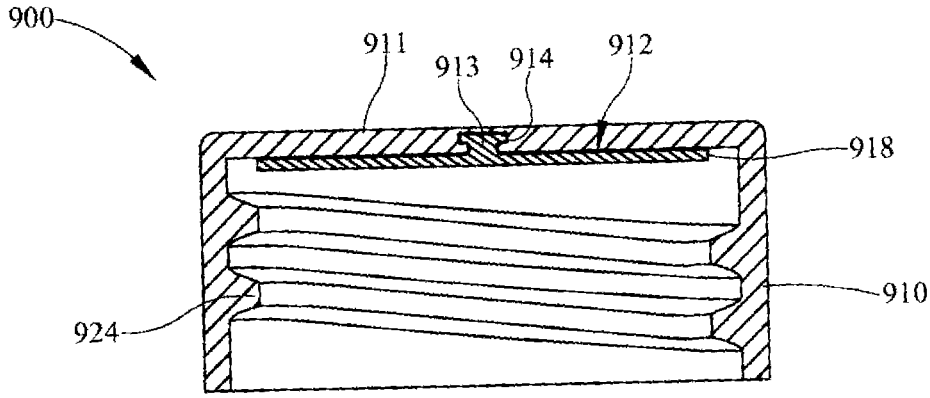

FIG. 12 shows peelable seal 1212 of the present invention in closure 1200 having seal retainer 1230 on container 1209 in a use condition. In this embodiment, seal retainer 1230 is a coextensive bead circumscribing the inner annular surface of side wall 1210 a sufficient distance from top wall 1211 rotatingly retaining an outer peripheral portion 1218 of seal 1212. Seal 1212 is shown sealed to container neck 1214 of container 1209. Peripheral portion 1218 of seal 1212 has at least one layer providing seal 1212 with a stiffening structure. Peripheral portion 1218 has a portion overhanging container neck retainer 1214 rotatingly engaging seal retainer 1230. Also shown in this embodiment is optional tamper evident ring 1225 and container threads 1216 interacting with closure threads 1224.

While there have been described several embodiments of the present invention, those skilled in the art will recognize that other and further changes and modifications may be made thereto without departing from the spirit of the invention, and it is intended to claim all such changes and modifications as fall within the true scope of the invention.

What is claimed is:

1. A closure for sealing a container, comprising:

a container having a container neck, said container neck having an opening defined by a container rim;

a closure axially removable from said container neck;

a generally disc shaped peelable seal rotatingly axially retained within said closure;

said seal having a central body portion and an overhang portion extending beyond a margin defined by said central body portion, said central body portion including a first layer and a second layer, said first layer forming said overhang portion extending beyond said container rim surrounding said opening of said container, wherein said first layer including a stiffening structure of such thickness and rigidity that said seal can be loosened by applying a vertical force to said overhang portion of said first layer;

said overhang portion extends from about 0.005 inches to about 0.25 inches beyond said container rim of said container neck;

said second layer of said seal being a sealant for bonding or sealing said first layer of said seal to said container rim and being a relatively low density and tensile strength; and said overhang portion of said generally disc shaped peelable seal being sufficiently rigid and nonflexible from said stiffening structure so that a seal retainer circumscribing an inner annular side wall of said closure applying said vertical force upwardly on said overhang portion of said first layer upon removal of said closure from said container neck thereby completely removing said bonded seal from said container rim and rotatingly axially retaining said seal within said closure when removing said closure from said container.

2. The closure of claim 1 wherein said seal retainer is in the form of a bead.

3. The closure of claim 1 wherein said seal retainer is in the form of an intermittent bead.

4. The closure of claim 1 wherein said closure has a top wall depending inward from an annular side wall.

5. The closure of claim 1, wherein said first layer has a constituent selected from the group consisting of polypropylene, polyethylene terephalate, polyvinylchloride, a stiff metallic material, paper, and combinations thereof.

6. The closure of claim 1, wherein said sealant has a constituent selected from the group consisting of polypropylene, polyethylene ethylene vinyl acetate copolymer, polyester, and combinations thereof.

7. A closure and container comprising:

a container having a container neck, said container neck having an opening defined by an upper rim;

a closure having a top wall with a depending annular side wall, wherein said annular side wall having an inner surface;

a helical thread depending inwardly from said inner surface of said annular side wall, wherein said closure threadably engaging said container neck;

said closure top wall having an inner surface and an outer surface with a centrally oriented through hole extending between said top wall inner surface and said top wall outer surface;

a generally disc shaped seal having a stiffening structure, said stiffening structure extending at least partially over an area of said seal within said closure, said stiffening structure further including a vertical post with a head projecting from the portion of said stiffening structure within said closure, wherein said head is positioned at a distal end of said post;

said post having a first diameter and said head having a second diameter, wherein said second diameter of said head is larger than said first diameter of said post;

said post extending through said hole of said closure top wall and said head positioned on said outer surface of said closure top wall, said second diameter of said head being greater than the diameter of said hole of said closure top wall; and wherein said seal is loosened by applying a vertical force to said head of said stiffening structure extending beyond the diameter of said top wall hole when removing said closure from said container thereby completely removing said disc shaped seal from sealing engagement with said container upper rim and axially retaining said seal within said closure.

8. A seal and closure combination comprising:

a container having a container neck, said container neck having an opening defined by an upper rim;

a closure threadably engaging said container neck, wherein a generally disc shaped seal is rotatingly held within said closure;

said seal having a body portion, said body portion having a first layer, an intermediate layer, and a sealant layer stacked together in a composite sheet with adhesives, said body portion forming an overhanging portion extending beyond said upper rim of said container, said first layer is from about 0.010 inches to about 0.25 inches in thickness, said intermediate layer is from about 0.001 inches to about 0.010 inches in thickness;

said sealant layer disposed so as to be adaptable for sealing or bonding of said body portion to said container rim and being a relatively low density and tensile strength;

said first layer of said body portion and said overhanging portion including a stiffening structure;

said intermediate layer is a foil layer for induction sealing said seal to said container upper rim; and a seal retainer applying a separating axial force to separate said seal from said upper rim of said container neck upon applying an upward removing force upon said closure from said container neck and rotatingly axially retaining said seal within said closure when removing said closure from said container.

9. The seal and closure combination of claim 8 wherein said seal retainer is in the form of a bead circumscribing a sidewall of said closure.

10. The seal and closure combination of claim 8 wherein said seal retainer is in the form of an intermittent bead circumscribing a sidewall of said closure.

11. The seal and closure combination of claim 8 wherein said stiffening structure of said seal extending at least partially over an area of said seal which is substantially parallel to the bonding plane of said seal.

12. The seal and closure combination of claim 8 wherein said overhanging portion extends from about 0.005 inches to about 0.25 inches beyond said container upper rim of said container neck.

* * * * *

UNITED STATES PATENT AND TRADEMARK OFFICE

CERTIFICATE OF CORRECTION

PATENT NO. : 7,780,024 B1
APPLICATION NO. : 11/339000
DATED : August 24, 2010
INVENTOR(S) : Marsella et al.

It is certified that error appears in the above-identified patent and that said Letters Patent is hereby corrected as shown below:

On Title Page 2 Item (56): replace "4,007,848 A 2/1977" with --4,007,848 A 2/1976--
Replace drawing sheet 6 containing Figures 8 and 9 with the attached replacement drawing sheet containing Figures 8 and 9.
Column 1, Line 46: replace "form" with --from--.

Signed and Sealed this
Thirty-first Day of July, 2012

David J. Kappos

David J. Kappos
*Director of the United States Patent and Trademark Office*